US006357493B1

(12) United States Patent
Shermer et al.

(10) Patent No.: US 6,357,493 B1
(45) Date of Patent: Mar. 19, 2002

(54) VAPOR RECOVERY SYSTEM FOR A FUEL DISPENSER

(75) Inventors: William P. Shermer, Greensboro; Kenneth L. Pope, Walkertown; Edward A. Payne, Greensboro, all of NC (US)

(73) Assignee: Marconi Commerce Systems Inc., Greensboro, NC (US)

( * ) Notice: Subject to any disclaimer, the term of this patent is extended or adjusted under 35 U.S.C. 154(b) by 0 days.

(21) Appl. No.: 09/694,421

(22) Filed: Oct. 23, 2000

(51) Int. Cl.[7] ..... B65B 1/04

(52) U.S. Cl. ..... 141/59; 141/83; 141/94

(58) Field of Search ..... 141/59, 94, 290, 141/392, 83, 95, 98, 285, 286

(56) References Cited

U.S. PATENT DOCUMENTS

| | | | | |
|---|---|---|---|---|
| 3,016,928 | A | 1/1962 | Brandt | 141/45 |
| 3,735,634 | A | 5/1973 | Clinton et al. | 73/64.2 |
| 4,147,096 | A | 4/1979 | Caswell | 98/122 |
| 4,166,485 | A | 9/1979 | Wokas | 141/52 |
| 4,215,565 | A | 8/1980 | Zanker | 73/30 |
| 4,543,819 | A | 10/1985 | Chin et al. | 73/64.2 |
| 4,566,504 | A | 1/1986 | Furrow et al. | 141/59 |
| 4,570,686 | A | 2/1986 | Devine | 141/286 |
| 4,611,729 | A | 9/1986 | Gerstenmaier et al. | 222/75 |
| 4,653,334 | A | 3/1987 | Capone | 73/863.81 |
| 4,687,033 | A | 8/1987 | Furrow et al. | 141/59 |
| 4,749,009 | A | 6/1988 | Faeth | 141/45 |
| 4,827,987 | A | 5/1989 | Faeth | 141/59 |
| 4,842,027 | A | 6/1989 | Faeth | 141/45 |
| 4,871,450 | A | 10/1989 | Goodrich et al. | 210/151 |
| 4,938,251 | A | 7/1990 | Furrow et al. | 137/269 |
| 4,967,809 | A | 11/1990 | Faeth | 141/59 |
| 4,986,445 | A | 1/1991 | Young et al. | 222/71 |
| 5,013,434 | A | 5/1991 | Furrow | 210/232 |
| 5,027,499 | A | 7/1991 | Prohaska | 29/595 |
| 5,040,576 | A | 8/1991 | Faeth | 141/45 |
| 5,040,577 | A | 8/1991 | Pope | 141/59 |
| 5,116,759 | A | 5/1992 | Klainer et al. | 435/288 |
| 5,129,433 | A | 7/1992 | Faeth | 141/45 |
| 5,143,258 | A | 9/1992 | Mittermaier | 222/73 |
| 5,156,199 | A | 10/1992 | Hartsell, Jr. et al. | 141/83 |
| 5,165,379 | A | 11/1992 | Thompson | 123/520 |
| 5,195,564 | A | 3/1993 | Spalding | 141/1 |
| 5,203,384 | A | 4/1993 | Hansen | 141/59 |
| 5,240,045 | A | 8/1993 | Faeth | 141/1 |
| 5,267,470 | A | 12/1993 | Cook | 73/49.7 |
| 5,269,353 | A | 12/1993 | Nanaji et al. | 141/59 |
| 5,323,817 | A | 6/1994 | Spalding | 141/1 |

(List continued on next page.)

FOREIGN PATENT DOCUMENTS

| | | |
|---|---|---|
| GB | 2316060 | 2/1998 |
| WO | WO00/50850 | 8/2000 |

*Primary Examiner*—Steven O. Douglas
(74) *Attorney, Agent, or Firm*—Withrow & Terranova PLLC

(57) ABSTRACT

A system and method for determining whether a vehicle is equipped with an ORVR system. A processor receives a signal from a fuel pump or the like indicating the fuel being dispensed by the fuel dispenser. The processor is programmed to determine a threshold vapor concentration level based on the signal. Processor further receives a signal from at least one environmental sensor indicating at least one environmental condition to which the fueling operation is exposed. The processor is further programmed to adjust the threshold vapor concentration either up or down dependent upon the environmental condition. Finally, processor receives an actual vapor concentration from a vapor sensor. The processor then compares the actual vapor concentration value with the adjusted threshold vapor concentration value to determine whether the vehicle is equipped with an ORVR system.

19 Claims, 5 Drawing Sheets

U.S. PATENT DOCUMENTS

| | | | | |
|---|---|---|---|---|
| 5,332,008 | A | 7/1994 | Todd et al. | 141/5 |
| 5,332,011 | A | 7/1994 | Spalding | 141/59 |
| 5,333,654 | A | 8/1994 | Faeth | 141/1 |
| 5,333,655 | A | 8/1994 | Bergamini et al. | 141/59 |
| 5,355,915 | A | 10/1994 | Payne | 141/83 |
| 5,365,985 | A | 11/1994 | Todd et al. | 141/392 |
| 5,386,812 | A | 2/1995 | Curran et al. | 123/520 |
| 5,417,256 | A | 5/1995 | Hartsell, Jr. et al. | 141/7 |
| 5,450,883 | A | 9/1995 | Payne et al. | 141/59 |
| 5,452,621 | A | 9/1995 | Aylesworth et al. | 73/864.81 |
| 5,460,054 | A | 10/1995 | Tran | 73/863.61 |
| 5,464,466 | A | 11/1995 | Nanaji et al. | 95/45 |
| 5,500,369 | A | 3/1996 | Kiplinger | 435/309.1 |
| 5,507,325 | A | 4/1996 | Finlayson | 141/83 |
| RE35,238 | E | 5/1996 | Pope | 141/59 |
| 5,542,458 | A | 8/1996 | Payne et al. | 141/7 |
| 5,563,339 | A | 10/1996 | Compton et al. | 73/64.45 |
| 5,563,341 | A | 10/1996 | Fenner et al. | 73/335.11 |
| 5,568,828 | A | 10/1996 | Harris | 141/348 |
| 5,571,310 | A | 11/1996 | Nanaji | 96/4 |
| 5,590,697 | A | 1/1997 | Benjey et al. | 141/59 |
| 5,592,979 | A | 1/1997 | Payne et al. | 141/59 |
| 5,625,156 | A | 4/1997 | Serrels et al. | 73/863.51 |
| 5,626,649 | A | 5/1997 | Nanaji | 95/12 |
| 5,663,492 | A | 9/1997 | Alapati et al. | 73/64.45 |
| 5,671,785 | A | 9/1997 | Andersson | 141/59 |
| 5,720,325 | A | 2/1998 | Grantham | 141/59 |
| 5,752,411 | A | 5/1998 | Harpster | 73/861.04 |
| 5,755,854 | A | 5/1998 | Nanaji | 95/11 |
| 5,780,245 | A | 7/1998 | Maroteaux | 435/7.21 |
| 5,782,275 | A | 7/1998 | Hartsell, Jr. et al. | 141/94 |
| 5,803,136 | A | 9/1998 | Hartsell, Jr. | 141/7 |
| 5,832,967 | A | 11/1998 | Andersson | 141/59 |
| 5,843,212 | A | 12/1998 | Nanaji | 96/4 |
| 5,850,857 | A | 12/1998 | Simpson | 141/59 |
| 5,857,500 | A | 1/1999 | Payne et al. | 141/59 |
| 5,860,457 | A | 1/1999 | Andersson | 141/59 |
| 5,868,175 | A | 2/1999 | Duff et al. | 141/59 |
| 5,878,790 | A | 3/1999 | Janssen | 141/59 |
| 5,889,202 | A | 3/1999 | Alapati et al. | 73/64.45 |
| 5,898,108 | A | 4/1999 | Mieczkowski et al. | 73/118.1 |
| 5,911,248 | A | 6/1999 | Keller | 141/59 |
| 5,913,343 | A | 6/1999 | Andersson | 141/159 |
| 5,942,980 | A | 8/1999 | Hoben et al. | 340/618 |
| 5,944,067 | A | 8/1999 | Andersson | 141/59 |
| 5,956,259 | A | 9/1999 | Hartsell, Jr. et al. | 364/528.37 |
| 5,988,232 | A | 11/1999 | Koch et al. | 141/59 |
| 5,992,395 | A | 11/1999 | Hartsell, Jr. et al. | 123/516 |
| 6,026,866 | A | 2/2000 | Nanaji | 141/59 |
| 6,037,184 | A | 3/2000 | Matilainen et al. | 436/177 |
| 6,038,922 | A | 3/2000 | Mauze et al. | 73/335.08 |
| 6,065,507 | A | 5/2000 | Nanaji | 141/59 |
| 6,070,453 | A | 6/2000 | Myers | 73/40.5 |
| 6,082,415 | A | 7/2000 | Rowland et al. | 141/59 |
| 6,102,085 | A | 8/2000 | Nanaji | 141/83 |
| 6,103,532 | A | 8/2000 | Koch et al. | 436/55 |
| 6,123,118 | A | 9/2000 | Nanaji | 141/4 |

VAPOR RECOVERY SYSTEM FOR A FUEL DISPENSER

FIELD OF THE INVENTION

The present invention is directed to a vapor recovery system within a fuel dispensing environment and, more particularly, to a vapor recovery system that senses at least one environmental condition at the time of the fueling operation to accurately determine the amount of vapor being returned.

BACKGROUND OF THE INVENTION

Petroleum or hydrocarbon based fueling systems have become increasingly regulated by state and federal authorities. One such regulation concerns the recovery of hydrocarbon vapor from the fuel tank of the vehicle being refueled. Absent any intervention, as fuel is introduced into the tank of the vehicle, vapor present in the tank is forced out through the filler neck and into the atmosphere. While there have been many studies as to the exact effect such emissions have on the atmosphere, the consensus appears to be, and certainly lawmakers believe, that such emissions contribute to the depletion of the ozone, may contribute to cancer rates, and are otherwise undesirable.

In response thereto, Stage II vapor recovery systems were promoted. The first systems were referred to as "balance" type systems whereby an accordion like sheath encircled the nozzle of the fuel dispenser and formed a seal around the opening of the fuel tank. Simple pressure forced the vapor out of the tank and down through the sheath into the hose for recovery. Later developments included an active vapor recovery system, such as that sold by the assignee of the present invention, and as explained in U.S. Pat. No. 5,040,577, now Reissue Pat. No. No. 35,238 to Pope. The term "vapor recovery system" used herein is understood to mean the Stage II systems which collect vapors during the fueling operation and direct them to a storage tank.

It is important that the vapor recovery system operates within an efficient range. If the system supplies too much vacuum during the fueling operation, the hydrocarbon vapors will be collected along with an excessive amount of air thereby over-pressurizing the underground storage tank. A relief valve on the storage tank will open at a predetermined pressure setting releasing the pressure and allowing the captured hydrocarbon vapors to escape into the environment. Conversely, an inadequate amount of vacuum prevents hydrocarbon vapors from being captured by the system at the necessary levels allowing the vapors to escape into the atmosphere at the vehicle fuel cap Still further advancements in the field of vapor recovery led to the development of Onboard Recovery Vapor Recovery (ORVR) vehicles, wherein the vehicle itself is equipped with a vapor recovery system. A typical ORVR vehicle is explained in U.S. Pat. Nos. 4,821,908, and 5,165,379.

One of the disadvantages of the parallel development of vapor recovery is that an ORVR system may compete with the vapor recovery system of the fuel dispenser if the fuel dispenser does not have knowledge of whether the vehicle being refueled is an ORVR-equipped vehicle. In such instances, energy is wasted as both systems try to recover vapors from the fuel tank, and excessive air is pumped into the storage tank as a result of vapor recovery efforts in the face of an ORVR system.

To overcome this problem, it is advantageous that the Stage II vapor recovery system identify whether the vehicle is equipped with an ORVR system. One way to make this determination is for the vapor recovery system to measure the amount of hydrocarbon vapor being returned to the underground storage tank during the fueling operation to determine if the vehicle is recovering vapors itself (i.e. ORVR-equipped vehicle). If the vehicle is ORVR-equipped, the vapor recovery system is shut down or modified. One drawback of this determination method is the amount of hydrocarbon vapors produced during the fueling operation may vary depending upon climatic conditions. Factors such as ambient temperature, vapor temperature measured in the vapor stream as it passes through the vapor recovery passage, vehicle fuel tank temperature, and others may all affect the amount of hydrocarbons produced.

By way of example, a vehicle being driven for a length of time while the ambient temperature is about 80 degrees Fahrenheit results in a hydrocarbon concentration level of around 50–60%. In another example, the same vehicle is parked in a garage for an extended time and removed and then refueled at a nearby station where the ambient temperature is about 80 degrees Fahrenheit. Although the ambient temperature is the same as the previous example, the fuel in the vehicle's tank may not reflect the ambient temperature and the hydrocarbon concentration is less. Therefore, even if the ambient temperature is at a value of about 80 degrees Fahrenheit it may not equate to a higher hydrocarbon level. In another example, many fuel injected vehicles will have a higher fuel/vapor temperature due to the fuel being recirculated from the injection pump back to the fuel tank itself.

Therefore, there is a need for a vapor recovery system that may receive various inputs that may affect an expected hydrocarbon threshold level. The calculated expected hydrocarbon threshold level that can then be compared to the actual amount of hydrocarbon vapor produced during the fueling operation. This comparison determines whether the vehicle is equipped with an ORVR system.

SUMMARY OF THE INVENTION

The present invention is directed to a system and method of determining whether a vehicle is equipped with an onboard recovery vapor recovery system. The invention determines a threshold vapor concentration level and senses environmental conditions during the fueling process to determine and varies the threshold level upwards or downwards. Additionally, an actual amount of hydrocarbon vapor is sensed. The two values are compared, and the vehicle is calculated to have an ORVR system if the actual value is below the adjusted threshold amount by a predetermined range.

In one embodiment, the method includes determining a fuel flow and a threshold vapor concentration. Environmental conditions are received from sensors at the fueling operation, and the threshold vapor concentration is adjusted upward or downward dependent upon the environmental conditions. The actual vapor concentration within the vapor recovery passage is sensed. Finally, the two values are compared to determine whether the vehicle is equipped with an onboard recovery vapor recovery system.

Within this embodiment, the threshold vapor concentration may be predetermined and based on tested results. Additionally, different types of vapor sensors may sense the actual vapor concentration within the vapor recovery passage. Sensors may include indirect or direct sensors.

A processor may be positioned within the fueling system for receiving signals from the various input devices and making calculations on whether the vehicle is equipped with an ORVR system. The processor may include a memory with look-up tables, or may be programmed to compute values based on predetermined mathematical formulas.

DETAILED DESCRIPTION OF THE INVENTION

The present invention relates to a fuel dispenser that uses climatic inputs to determine a hydrocarbon threshold level. During a fueling operation, the system compares the value with an actual hydrocarbon amount with the threshold hydrocarbon level to determinine whether the vehicle is equipped with an ORVR system. The term "threshold amount" refers throughout as the expected amount of hydrocarbon vapor that will be produced during a fueling event as determined by a processor 200. "Actual amount" is the amount of hydrocarbons actually sensed by a vapor sensor 80 positioned within a vapor recovery passage 8. The terms "vapor level", "vapor concentration" and the like are used interchangeably herein.

Figure 1:
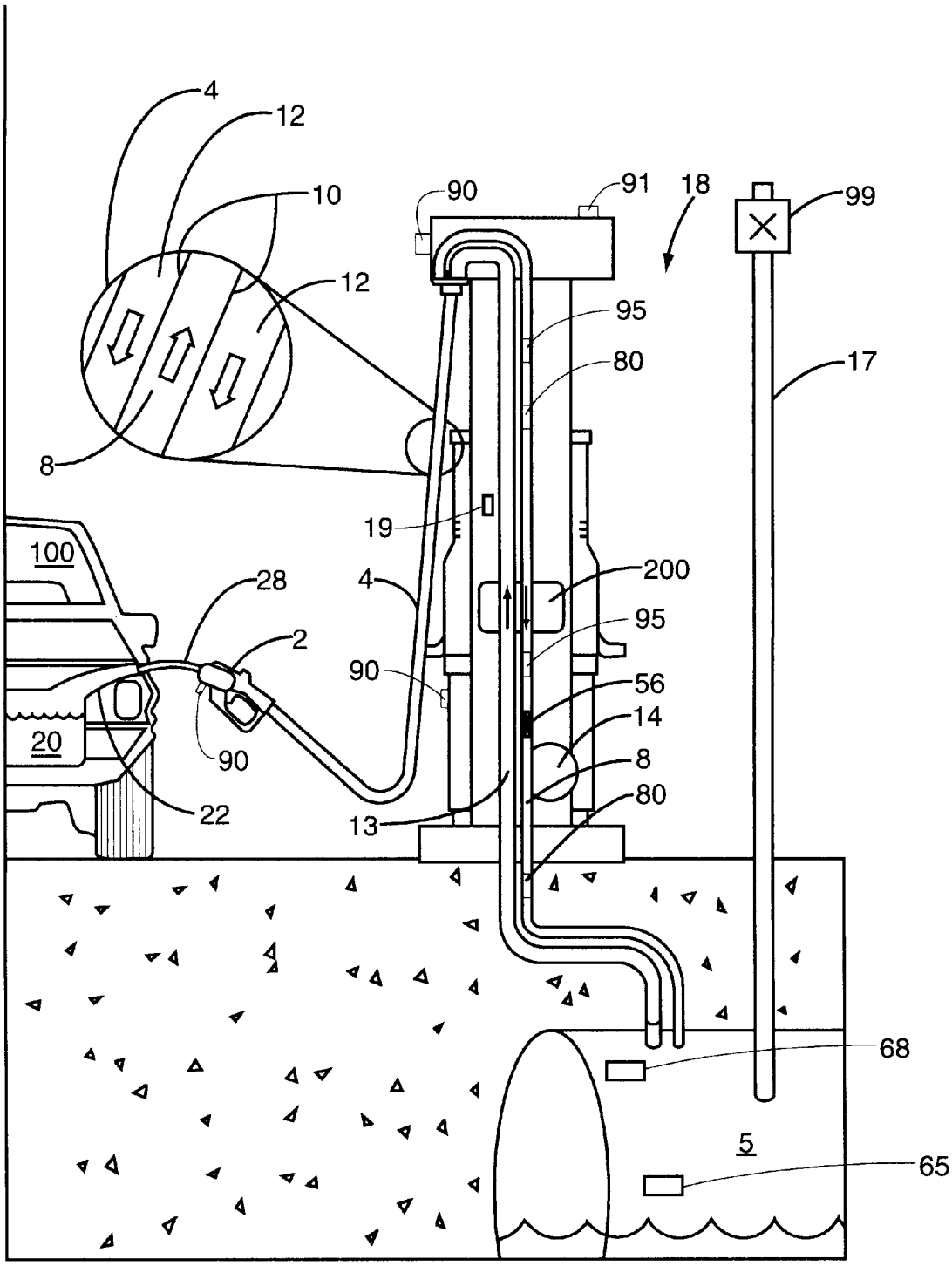
FIG. 1 is a side view illustrating a fuel dispenser constructed in accordance with one embodiment of the present invention.

Referring now to the drawings in general and FIG. 1 in particular, it will be understood that the illustrations are for the purpose of describing a preferred embodiment of the invention and are not intended to limit the invention thereto. As best seen in FIG. 1, in a typical service station, a vehicle 100 is illustrated being fueled from a fuel dispenser or gasoline pump 18. A spout 28 of nozzle 2 is shown inserted into a filler pipe 22 of a fuel tank 20 during the refueling of the vehicle 100.

A fuel delivery hose 4 having vapor recovery capability is connected at one end to the nozzle 2, and at its other end to the fuel dispenser 18. As shown by the cutaway view of the interior of the fuel delivery hose 4, a fuel delivery passage 12 is formed within the fuel delivery hose 4 for distributing liquid gasoline pumped from an underground storage tank 5 to the nozzle 2. A fuel pump 68 delivers the fuel from the underground storage tank 5 to the nozzle 2. A fuel meter 19 may be positioned along the fuel delivery line for determining the amount of fuel delivered from the underground storage tank 5. One skilled in the art will recognize that the fuel pump 68 and fuel meter 19 both may be positioned at a variety of locations along the fuel delivery line.

Figure 2:
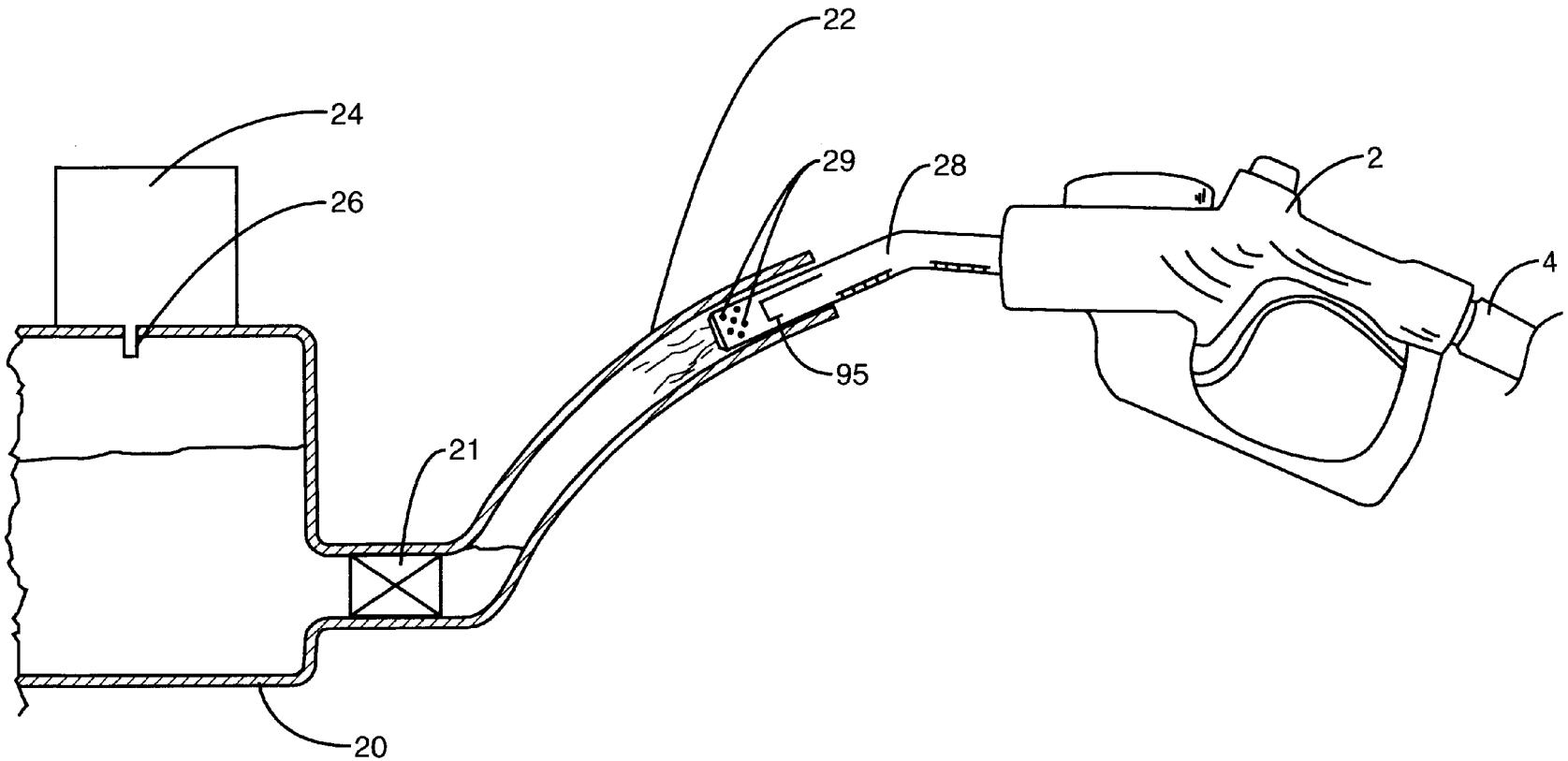
FIG. 2 is a side view illustrating a fuel dispenser nozzle inserted into a vehicle fuel tank having an ORVR system.

The spout 28 of the nozzle 2 has numerous apertures 29 (see FIG. 2). The apertures 29 provide an inlet for fuel vapors to enter the vapor recovery path 8 of fuel dispenser 18 from the vehicle's filler pipe 22. As liquid fuel rushes into the fuel tank 20 during the fueling operation of a vehicle not equipped with an ORVR system, fuel vapors are forced out of the fuel tank 20 through the fill pipe 22. The fuel dispenser's vapor recovery system pulls fuel vapor through the vapor recovery apertures 29, along the vapor recovery path 8 and ultimately into the underground tank 5.

Vapor recovery passage 8 transfers fuel vapors expelled from the vehicle's fuel tank 20 to the underground storage tank 5. The fuel delivery hose 4 is depicted as having an internal vapor recovery hose 10 for creating a section of the vapor recovery passage 8. The terms "vapor recovery passage" and "vapor return passage" as used herein refer to the flow path along which vapors recovered from a vehicle travel as they are returned to a storage point. One such storage point is an underground tank 5, however, other types of storage points to include intermediate vapor collection devices may also be used. Thus, any device installed in a vapor return passage may be installed at various positions along the path described above.

A vapor recovery pump 14 provides a vacuum in the vapor recovery passage 8 for removing fuel vapor during the fueling operation. The terms "fuel vapor" and "hydrocarbon vapor" are used throughout to include vapors produced during the fueling operation that contain hydrocarbons and other potentially harmful or ozone depleting elements. The vapor recovery pump 14 may be placed anywhere along the vapor recovery passage 8 between the nozzle 2 and the underground fuel storage tank 5. The vapor recovery system using the pump 14 may be any suitable system such as those shown in U.S. Reissue Pat. No. 35,238; and U.S. Pat. Nos. 5,195,564; 5,333,655; or 3,016,928. Various ones of these systems are now in commercial use, recovering fuel vapor during refueling.

The present invention may be applied with either constant speed or variable speed vapor pumps. A constant speed vapor pump includes a mechanism to control vapor return flow usually in the form of at least one valve 56 positioned along the vapor recovery passage 8. Valve 56 is selectively positionable between a variety of open and closed orientations to control the amount of vapor pressure pulled through the passage 8. The constant speed vapor pump may be located in each fuel dispenser 18, or in a central location such as that shown in U.S. Pat No. 5,417,256 entitled "Centralized vacuum assist vapor recovery system," incorporated herein by reference in its entirety. A variable speed vapor pump may be operated at a variety of speeds to control vapor flow through the passage without the need for valves.

As illustrated in FIG. 1, the underground tank 5 includes a vent 17 and a pressure-vacuum vent valve 99 for venting the underground tank 5 to atmosphere. The vent 17 and vent valve 99 allow the underground tank 5 to breathe in order to substantially equalize the ambient and tank pressures. In typical applications, maintaining tank pressure between the limits of pressure and vacuum is sufficient. Typical ranges of pressure and vacuum will range between +3 inches of water to −8 inches of water.

Turning now to FIG. 2, there is illustrated a schematic representation of a vehicle fuel tank 20 of a vehicle having an associated ORVR system 24. These ORVR systems 24 typically have a vapor recovery inlet 26 extending into the tank 20 (as shown) on the filler pipe 22 and communicating with the ORVR system 24. In the ORVR system of FIG. 2, incoming fuel provides a temporary seal in fill neck 22 to prevent vapors from within the tank 20 to escape. This sealing action is often referred to as a liquid seal. As the tank fills, pressure within tank 20 increases and forces vapors into the ORVR system 24 through the vapor recovery inlet 26. Other ORVR systems may use a check valve 21 along the fill neck 22 to prevent further loss of vapors. The check valve 21 is normally closed and opens when a set amount of gasoline accumulates over the check valve within the fill neck 22.

Thermometers may be placed at various locations throughout the fuel delivery and vapor recovery systems as illustrated in FIG. 1. One such thermometer that may be used with the present invention is discussed in U.S. Pat. No. 6,038,922, entitled "Thermometric apparatus and method for determining the concentration of a vapor in a gas stream," incorporated herein by reference in its entirety, but any suitable thermometer or temperature sensing device may be used with the present invention and is not limited to any particular type or method. An ambient temperature at the fuel dispenser 18 is determined by thermometer 90 that may be placed at numerous locations including an upper section of the fuel dispenser 18, lower section of the fuel dispenser 18, along the fuel delivery hose 4, or nozzle 2. Additionally, more than one thermometer 90 may be positioned at the fuel dispenser 18. Each thermometer 90 reading is signaled to the processor 200 which may average the temperature readings, or use one thermometer 90 with the others as backups in the event of failure of the first. Likewise, humidity sensor 91 is positioned within the fuel dispenser environment to sense the humidity levels and signal the results to processor 200. One example of a humidity sensor is discussed in U.S. Pat. No. 5,752,411 entitled "Method for measuring the air flow component of air/water vapor streams flowing under vacuum," incorporated herein by reference in its entirety, but any suitable humidity sensor or sensing device may be used with the present invention as it is not limited to any particular type or method.

A vapor thermometer 95 may be positioned within the vapor recovery passage 8 for sensing the vapor temperature. Thermometer 95 may be placed within the nozzle 2 as illustrated in FIG. 2 for determining the temperature of the vapors emanating during the fueling operation. In one embodiment, thermometer 95 is positioned within the spout 28 that affords it some protection as it is shielded from contact with the nozzle receptacle, and the vehicle fuel tank 20. Thermometers may also be positioned along the vapor recovery passage 8 at a point between the nozzle 2 and the underground storage tank 5. Additionally, more than one thermometer 95 may be positioned within the vapor recovery system in the event of damage to a first thermometer 95, or to use an average of the temperatures.

A vapor sensor 80 is positioned along the vapor recovery passage 8 to determine the amount of actual fuel vapor. Vapor sensor 80 may be positioned at a variety of locations along the passage 8 from the nozzle 2, to directly upstream of the storage tank 5. Additionally, more than one vapor sensor 80 may be positioned along the vapor recovery passage 8. By way of example, a first vapor sensor 80 may be positioned upstream of the vapor pump 14 adjacent to the fuel delivery hose 4 and a second vapor sensor 80 positioned downstream of the vapor pump 14 adjacent to the storage tank 5 application Ser. No. 09/442,263 entitled "Vapor Flow And Hydrocarbon Concentration Sensor For Improved Vapor Recovery In Fuel Dispensers," and application Ser. No. 09/188,860 entitled "Hydrocarbon Vapor Sensing," both assigned to the same assignee of the present invention and both incorporated herein by reference in its entirety, disclose various locations for the vapor sensor 80 in and proximate to a fuel dispenser 18 that all are possible locations of the vapor sensor 80 for the present invention.

Figure 3:
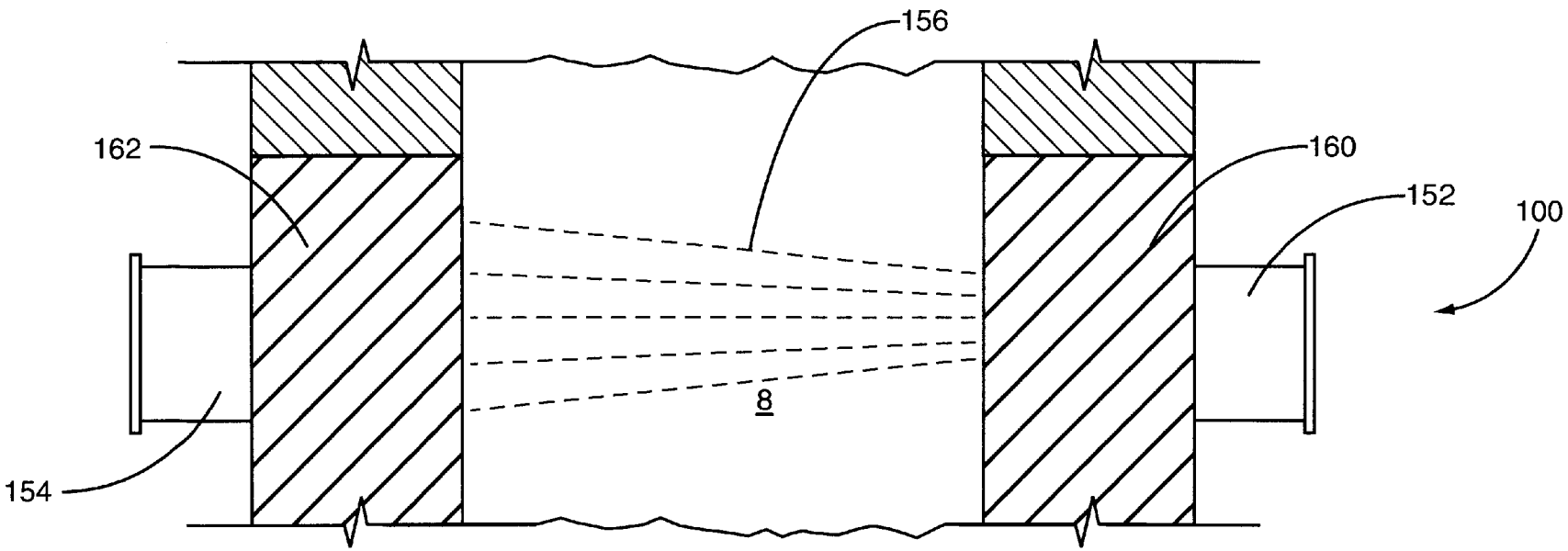
FIG. 3 is a side view illustrating an infrared vapor sensor used in accordance with one embodiment of the present invention.

FIG. 3 illustrates one embodiment of a sensor 100 as being an infrared sensor positioned within the sensor chamber 91. Sensor includes an infrared emitter 152 and an infrared detector 154 like that described in "Infrared Light Sources" dated February 2000 and manufactured by Ion Optics, Inc. that is herein incorporated by reference in its entirety. Preferably, the infrared emitter 152 is either a solid state or a black body radiator with an appropriate filter, if required. The infrared emitter 152 irradiates to the infrared detector 154 through a cross-section of sampled vapor within the vapor recovery passage 8. The infrared detector 154 is either solid state or pyro-electric infrared (PIR). The attenuation in the infrared spectrum 156 caused by the absorption of infrared by hydrocarbons is detected by the detector 154.

The infrared emitter 152 contains a window 160 through which the infrared spectrum 156 emitted by the infrared emitter 152 passes. The primary purpose of the window 160 is to provide a barrier to prevent the infrared emitter 152 from being contaminated by the vapor. In order for the infrared spectrum 156 to pass through for detection by the infrared detector 154, the window 160 allows light of the infrared spectrum 156 to pass through. The wavelength of the infrared spectrum 156 wavelengths is approximately 4 micrometers and the hydrocarbon vapor is sensed at approximately 3.3 to 3.4 micrometers. The preferred embodiment uses a window 160 constructed out of sapphire because it does not attenuate the infrared spectrum 156 materially at this wavelength. However, windows 160 made out of germanium, calcium flouride or silicon may be better for infrared spectrums 156 with longer wavelengths. Similarly, the infrared detector 154 also has a window 162 to allow the infrared spectrum 156 to pass through for the same reasons as discussed above. U.S. patent application Ser. No. 09,442,263 discloses the sensor and is herein incorporated by reference in its entirety.

A vapor sensor, such as an infrared sensor illustrated in FIG. 3, is generally referred to as an indirect sensor because the vapor does not contact the actual sensor. The infrared spectrum 156 travels through the vapor recovery passage 8 as the actual sensor remains outside of the passage. Alternatively, sensor 80 may be a direct sensor in which it placed within the vapor recovery passage 8 and vapor directly contacts the sensor. Alternatively, a chamber containing the sensor may extend from the vapor recovery passage 8. Vapors enter the chamber and contact the sensor 80, but liquid fuel collected in the line does not contact and foul the sensor. This embodiment is disclosed in U.S. patent application Ser. No. 09/188,860, and U.S. Pat. No. 5,116,759, both herein incorporated by reference in their entirety.

Sensor 80 may monitor either the hydrocarbon or other element normally found in air such as oxygen concentration. By way of example, U.S. Pat. No. 5,832,967 discloses a direct sensor and oxygen sensor, and is incorporated by reference herein in its entirety. It will be readily understood that any particular hydrocarbon content of the vapor flow has a corresponding oxygen content. That is, if the hydrocarbon content is 5% then the remain 95% is comprised of air further comprising oxygen, nitrogen, and other elements normally found in air. Knowing the concentration of an element normally found in air, such as oxygen, allows the system to determine the amount of hydrocarbon. For example, if air is comprised of 15% oxygen and the concentration of oxygen measured in the vapor recovery passage 8 is 3%, the concentration of hydrocarbon would be approximately 80% since a 3% oxygen concentration equals approximately a 20% air concentration. The hydrocarbon concentration is 100% minus the air concentration. Just as an oxygen sensor is used in this example, a nitrogen sensor or other sensor of an air element may be used as well. Thus, the control of the vapor recovery system described herein above may be achieved by monitoring the oxygen content of the vapor flow as well as the hydrocarbon content thereof. A system for using vapor flow oxygen content in this fashion is disclosed in United Kingdom published patent application 2 316 060 ("the '060 patent publication"), the content of which is incorporated herein by reference. The '060 patent publication system relies on the expected increased oxygen content of the return vapor flow from an ORVR vehicle to halt operation of a vacuum pump. The system and method disclosed in U.S. Pat. No. 5,782,275, which is herein incorporated by reference in its entirety, could also be adapted for use with an oxygen sensor by including an additional component that would convert information regarding oxygen content to hydrocarbon content. This component could include a hard wired device included as part of the sensor 80 itself, or, alternatively, software instructions contained in the processor 200. In its broadest aspect then, the present invention includes the provision of a vapor sensor in fluid communication with the return vapor flow. This sensor could be a hydrocarbon sensor or an oxygen sensor. The term "vapor sensor" and the like used throughout is meant to include both a hydrocarbon sensor and an oxygen sensor.

Processor 200 receives data from at least the vapor sensor 80 and processes whether the vehicle is equipped with an ORVR system. Processor 200 may be a microprocessor with an associated memory or the like and also operates to control the vast majority of the various functions of the fuel dispenser 18 including, but not limited to fuel transaction authorization, encryption associated with fuel transaction authorization, fuel grade selection, display and/or audio control. Processor 200 may actually comprise two or more microprocessors that may communicate with one another. Recent advances in the technology associated with the fuel dispenser 18 now enable the fuel dispenser 18 to act as an Internet interface, provide content, allow music downloads, or other functionality.

Figure 4:
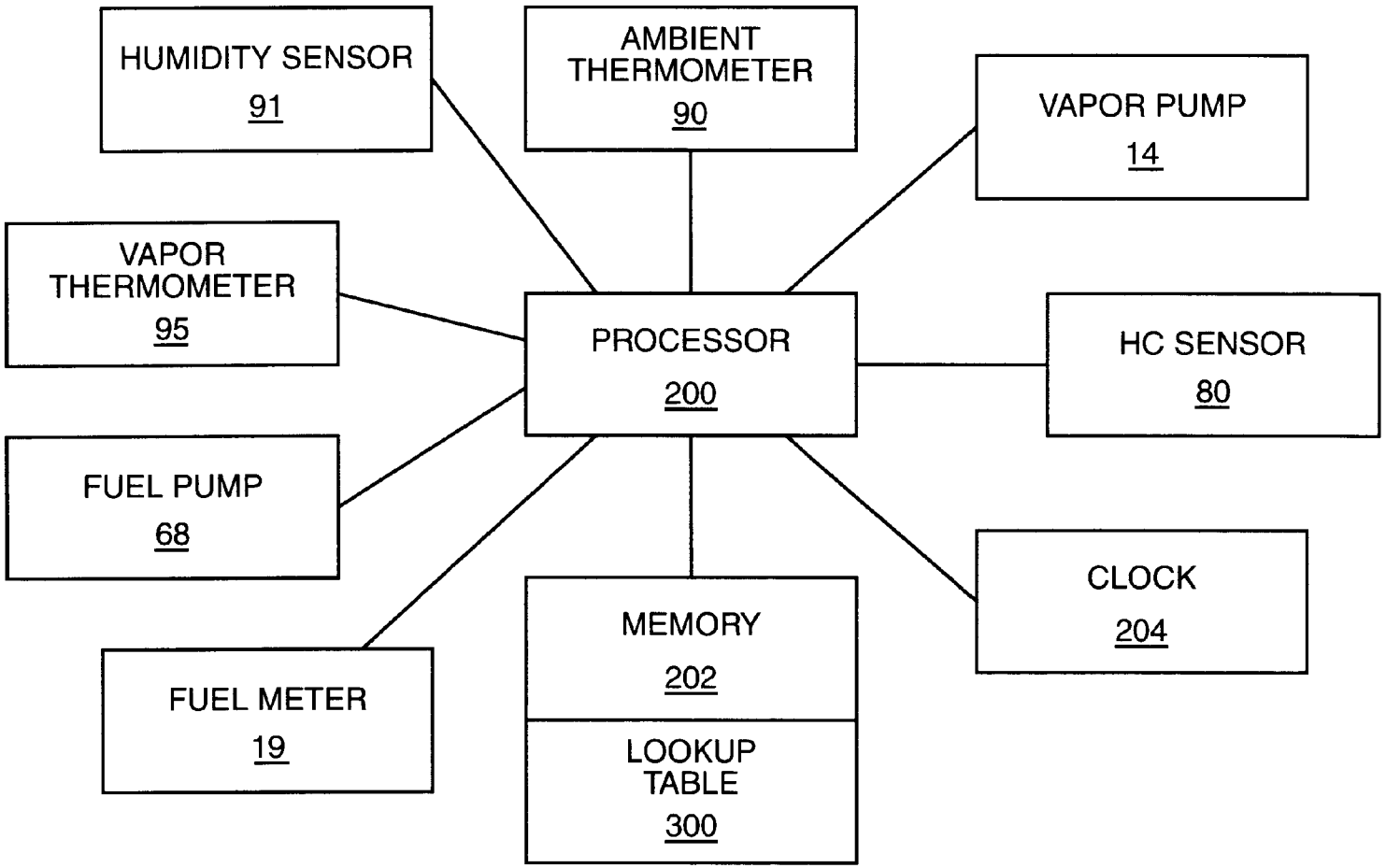
FIG. 4 is a schematic diagram illustrating the processor and the various inputs received by the processor.

FIG. 4 illustrates a schematic illustration of the inputs received and accessible to the processor 200. Vapor sensor 80, ambient thermometer 90, and vapor thermometer 95 each send signals to the processor 200 indicative of the sensed environment. Clock 204 maintains the time of day, and may also include a calendar function.

Fuel pump 68 signals the amount of fuel dispensed during a fueling operation. In one embodiment, a fuel pulse is generated as fuel is dispensed for a precise volume of fuel dispensed. Processor 200 accumulates the pulse count and, based on the fuel pulse count and fuel volume per pulse, may determine the amount of fuel dispensed. Fuel meter 19 operates in a like manner to indicate the amount of fuel flowing through the fuel delivery line. Fuel meter 19 may be the only source of fuel flow information, or may provide a redundant fuel flow reading to the processor 200 that is used in combination with the fuel pump 68.

Processor 200 is programmed to compute a threshold amount of vapor produced during a steady-state fueling operation in which the flow rate is relatively constant. By way of example, processor 200 correlates 1000 pulses per minute as a flow rate of one gallon per minute, which in turn produces a certain vapor concentration. In one embodiment, the threshold level of vapor concentration is a predetermined amount calculated in laboratory testing. This value is stored in memory 202 which processor 200 accesses upon being signaled of fuel flow. The threshold level is then supplemented by variable values stored within memory 202.

In one embodiment, memory 202 includes at least one look-up table 300 having pre-computed dependent values for the threshold amounts of vapor concentration produced during the fueling process. Look-up techniques are disclosed in U.S. Pat. No. 5,592,979, which is herein incorporated by reference in its entirety.

Another embodiment features the vapor temperature within the vapor recovery passage 8 to be most reliable for determining the hydrocarbon concentration. In one example, a vehicle being driven from some undetermined mileage at an ambient temperature of about 80 degrees Fahrenheit refuels resulting in a hydrocarbon concentration level of about 50–60%. The same vehicle in another example may be stored in cooled and shaded garage before being removed and refueled at a nearby gas station where the ambient temperature is about 80 degrees Fahrenheit. The hydrocarbon concentration level will be below the previous example, even though the ambient temperature is the same.

Other methods of calculated the expected vapor concentration may be included in the present invention. Another method includes a single complex look-up table that factors in a plurality of the received variables. Variables may include the hydrocarbon concentration, and environmental conditions. The complex table need only be accessed by processor 200 once to determine the expected levels. An advantage of having only one complex table is the reduced processing time for processor 200 to calculate an updated vapor level. However, the complex table may require more space within memory 202.

Another method may include mathematical equations for determining the threshold and variable vapor concentration amounts. Values obtained from the fuel flow meter 19 or fuel pump 68, along with any environmental conditions from sensors, are input into equations for determining the threshold vapor concentration.

It should be recognized that the present invention uses environmental inputs for sensors and other devices that may affect vapor concentration levels to adjust the vapor concentration threshold level and that the present invention in not limited to any particular method or manner of calculation of processing to determine any adjustment to the vapor concentration threshold level based on the environmental inputs.

Figure 5:
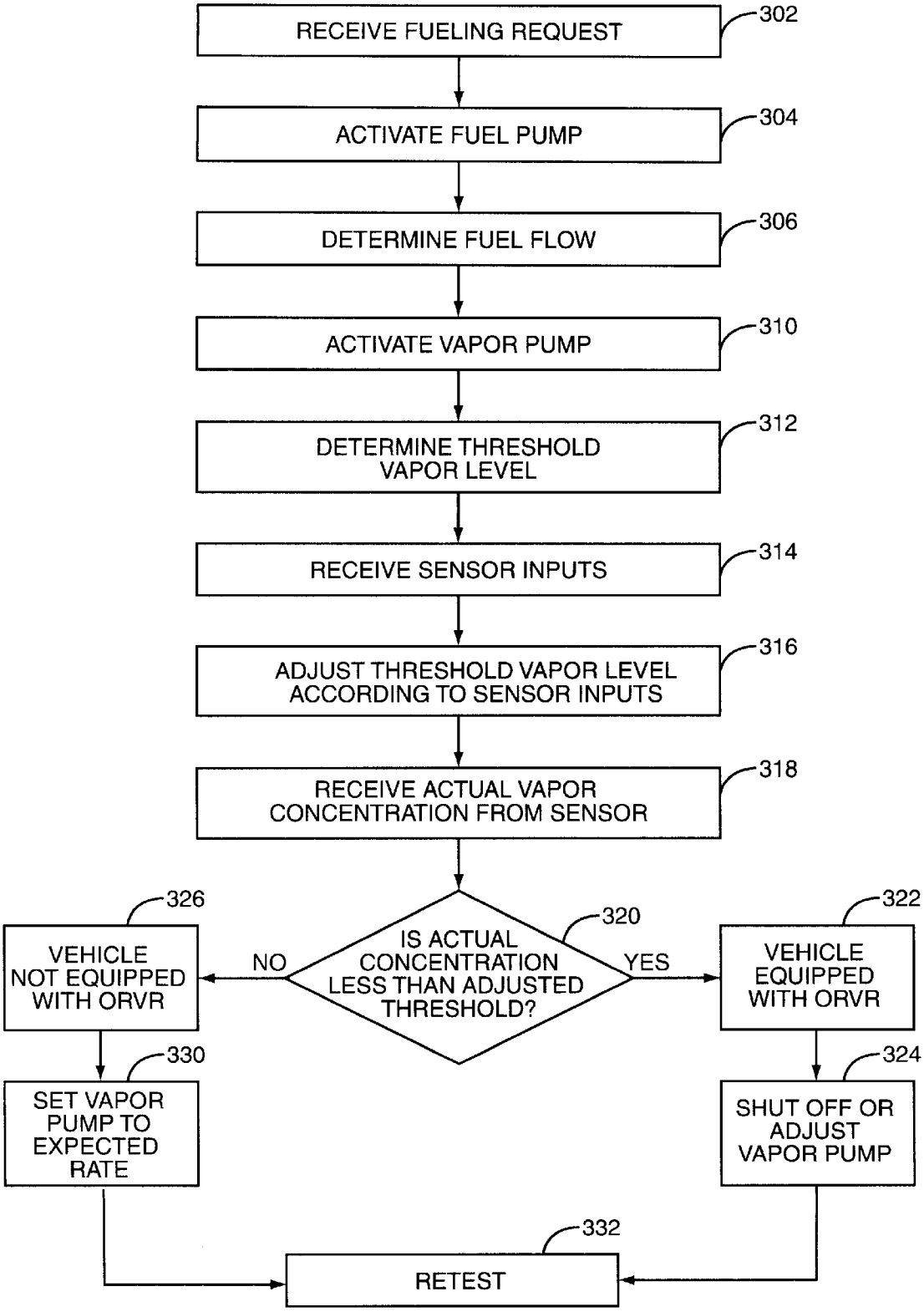
FIG. 5 is a flowchart illustrating the steps of determining an ORVR vehicle in accordance with one embodiment of the present invention.

FIG. 5 illustrates the steps of a fueling process and setting the vapor pump rate. Processor 200 receives a fueling request from an operator (block 302). This may include receipt of a valid credit card number from the user, toggling a switch on the exterior of the fuel dispenser 18, touch pad input on an input display, or other well know activation requests. Thereafter, processor 200 activates the fuel pump and fuel is dispensed at the rate the operator squeezes the handle on the nozzle 2 with the fuel flow rate signaled to the processor 200.

The vapor recovery pump 14 is activated (block 304) once fuel is dispensed by the fuel pump 68. Upon the initial dispensing of fuel into the vehicle tank 20, a large plume of vapors which has been housed in the tank 20 is often released through the fuel tank neck 22. This initial plume may occur too early in the fueling process for the processor 200 to receive accurate readings from the sensors to set the vapor pump 14 at the expected rate. To ensure this initial plume is captured, vapor pump 14 may be activated at an initial setting and then reduced to a lower rate thereafter.

Upon receiving a fuel flow rate, processor 200 determines the initial threshold vapor concentration level (block 312). Determining this level may include accessing the value from a look-up table 300 stored in memory, or calculating the level from a formula. Processor 200 receives signals sent from the sensors 90, 91, 95 indicating the ambient temperature, vapor temperature, humidity levels, and other climatic environmental conditions (block 314). From these signals, processor 200 accesses the look-up table or tables within memory 202 and determines variations in the threshold levels. Processor 200 than adjusts the threshold level based on these variations (block 316). As before, processor 200 may also include these variables in a mathematical formula to determine the adjusted vapor concentration level. The actual vapor concentration within the vapor recovery passage 8 is signaled from the hydrocarbon sensor 80 (block 318).

Processor 200 next compares the adjusted hydrocarbon level with the obtained amount from the sensor 80 (Decision 320). If the actual vapor concentration level is less than the adjusted threshold, processor 200 assumes that the vehicle is equipped with an ORVR system (block 322). Processor 200 may allow for a range of acceptance that allows for slight variations in the results. The range of acceptance may vary depending upon the specific embodiment. By way of example, if the actual concentration is at least 5% less than the adjusted value, processor 200 may assume the vehicle has an ORVR system. After determining an ORVR system exists, processor 200 may then determine whether the vapor pump 14 should remain activated and at what appropriate setting (block 324). An actual concentration level of less than a predetermined amount may allow the processor 200 to completely deactivate the vapor pump 14 as the ORVR system is adequately collecting the vapors. Alternatively, an actual reading above the predetermined level may result in the vapor pump 14 remaining activated and being set at a level corresponding to the actual amount. Processor 200 may be further programmed to set the vapor pump speed at an appropriate level depending upon a calculation of the threshold amounts and actual vapors levels. U.S. Pat No. 5,592,979, already incorporated herein, discloses several manners of determining this level.

When the actual vapor concentration is greater than or at least within a range of the adjusted threshold, processor 200 assumes the vehicle is not equipped with an ORVR system (block 326). Processor 200 may take one reading during the fueling operation and set the vapor pump 14 in accordance with the results. Another embodiment provides for processor 200 to take readings throughout the fueling operation and constantly test for the existence of an ORVR system, and to ensure that produced vapors are being captured (block 332).

Inconsistent results of the processor may further be logged either within memory 202, or a communication sent to a remote location. The date and time of the inconsistent result obtained from clock 204 may further be included to assist in determining causes and possible solutions of any problems. Repetitive inconsistencies may indicate a need for service with at least one component of the system which is causing inaccurate vapor recovery results. One example of an inconsistency is an actual vapor level greatly higher than the adjusted threshold. This indicates that either the threshold amount was not accurately calculated, or the vapor sensor is malfunctioning.

The present invention may be carried out in other specific ways than those herein set forth without departing from the scope and essential characteristics of the invention. The present embodiments are, therefore, to be considered in all respects as illustrative and not restrictive, and all changed coming within the meaning and equivalency range of the appended claims are intended to be embraced therein.

What is claimed is:

1. A method of determining whether a vehicle is equipped with an onboard recovery vapor recovery system, said method comprising the steps of:

a) determining fuel flow and determining a threshold vapor concentration;

b) receiving an input from a sensor indicative of an environmental condition;

c) adjusting the threshold vapor concentration by a factor based on the input;

d) sensing an actual vapor concentration emanating from the vehicle; and e) comparing the adjusted threshold vapor concentration with the actual vapor concentration to determine whether the vehicle is equipped with an onboard recovery vapor recovery system.

2. The method of claim 1, wherein the threshold vapor concentration is predetermined and based on tested results.

3. The method of claim 2, wherein sensing the environmental conditions is performed by sensors positioned within the fuel dispenser environment.

4. The method of claim 1, wherein sensing the actual vapor concentration is performed with a vapor sensor.

5. The method of claim 1, wherein determining the vehicle is equipped with an onboard recovery vapor recovery system when the actual vapor concentration is below a predetermined level of the adjusted threshold vapor concentration.

6. The method of claim 1, wherein sensing the actual vapor concentration is performed indirectly.

7. The method of claim 1, wherein sensing the actual vapor concentration is performed directly.

8. The method of claim 1, wherein the threshold vapor concentration and the input are accessed from memory.

9. A method of determining a vehicle having an ORVR system, said method comprising the steps of:

a) operatively connecting a fuel flow meter to a processor, the fuel flow meter sending signals to the processor indicative of a fuel flow rate and the processor determining a threshold vapor concentration;

b) operatively connecting an environmental sensor to the processor, the processor adjusting the threshold vapor concentration a predetermined amount based upon signals received from the environmental sensor;

c) operatively connecting a vapor sensor to the processor, the vapor sensor sending a signal of an actual vapor concentration;

d) comparing the actual vapor concentration with the adjusted threshold vapor concentration and determining the vehicle is equipped with an ORVR system when a difference in the concentrations exceeds a predetermined amount.

10. A system for determining a vehicle having a vapor recovery system, said system comprising:

a. a vapor recovery line, said line extending between a first end positioned adjacent to a fuel nozzle and a second end terminating within a storage tank;

b. a fuel pump operatively connected to a fuel line for pumping fuel to the vehicle;

c. a vapor pump operatively connected to said vapor recovery line, said pump drawing vapor into said first end and delivering the vapor into the storage tank;

d. an environmental sensor for determining an environmental variable;

e. a vapor sensor positioned within said vapor recovery line for determining an actual vapor concentration; and f. a processor for receiving signals from said fuel pump, said vapor pump, and said environmental sensor, said processor accessing a memory having a threshold vapor level stored therein corresponding to said signal received from said fuel pump, said processor accessing said memory to retrieve a factor variable stored therein to adjust said threshold vapor level, and said processor comparing said adjusted threshold vapor level with said actual vapor concentration to determine whether the vehicle is equipped with an ORVR system.

11. The system of claim 10, wherein said vapor sensor is a hydrocarbon sensor.

12. The system of claim 10, wherein said vapor sensor is an infrared sensor.

13. The system of claim 10, wherein said vapor sensor is an oxygen sensor.

14. The system of claim 10, wherein said vapor pump operates at a constant speed.

15. The system of claim 10, wherein said vapor pump operates at a variable speed.

16. The system of claim 10, wherein said environmental sensor determines an ambient temperature external to the vapor recovery line.

17. The system of claim 10, wherein said environmental sensor is positioned within the vapor recovery line for determining the temperature of the vapor.

18. An apparatus for detecting a vehicle having a vapor recovery system, said apparatus comprising:

a) a fuel dispenser configured to deliver fuel to a fuel tank of a vehicle, said fuel dispenser providing a first signal indicative of a fuel flow rate;

b) an environmental sensor positioned about said fuel dispenser, said environmental sensor providing a second signal indicative of an environmental condition;

c) a vapor sensor positioned within said vapor recovery system for sensing vapor concentration and providing a signal indicative of the vapor concentration; and d) a processor configured to determine whether said vehicle is equipped with the vapor recovery system based on a value dependent on said first and second signals compared to said vapor concentration signal.

19. The method of claim 18, wherein the environmental sensor is a temperature sensor positioned within a vapor recovery line.

* * * * *